United States Patent [19]

Rorden et al.

[11] Patent Number: 4,878,053

[45] **Date of Patent: * Oct. 31, 1989**

[54] ACTUATION METHOD

[75] Inventors: Louis H. Rorden, Los Altos; T. Charles Moore, Sunnyvale, both of Calif.

[73] Assignee: Develco, Inc., San Jose, Calif.

[ * ] Notice: The portion of the term of this patent subsequent to Oct. 21, 2003 has been disclaimed.

[21] Appl. No.: 181,678

[22] Filed: Apr. 14, 1988

Related U.S. Application Data

[62] Division of Ser. No. 730,397, May 3, 1985, Pat. No. 4,736,791.

[51] Int. Cl.[4] ..... G01V 1/40

[52] U.S. Cl. ..... 340/853; 340/855; 340/861; 166/66.4

[58] Field of Search ..... 166/65.1, 66.4, 66.5; 181/102, 103; 340/853–856, 860, 861; 346/33 WL; 364/422; 367/27, 33, 81, 911, 912

[56] References Cited

U.S. PATENT DOCUMENTS

| | | | |
|---|---|---|---|
| 389,100 | 9/1888 | Newman | 251/68 |
| 847,268 | 3/1907 | Wirt | 251/74 |
| 1,026,041 | 5/1912 | Kimball | 251/68 |
| 1,145,703 | 9/1915 | Raymaker | 251/68 |
| 1,183,815 | 5/1916 | Hasty | 251/68 |
| 2,158,753 | 5/1939 | Hansen | 251/74 |
| 2,181,523 | 11/1939 | Shiels | 251/68 |
| 2,321,095 | 6/1943 | Mantz | 251/69 |
| 2,322,639 | 6/1943 | Kuhles | 251/68 |
| 2,354,887 | 9/1944 | Silverman et al. | 177/352 |
| 2,411,696 | 11/1946 | Silverman et al. | 177/352 |
| 2,665,714 | 1/1954 | Greenwood | 251/73 |
| 2,875,616 | 3/1959 | Marks | 74/2 |
| 3,095,901 | 7/1963 | Larson et al. | 137/522 |
| 3,189,316 | 6/1965 | Preston, Jr. | 251/74 |
| 3,229,713 | 1/1966 | Wiegand | 137/467 |
| 3,333,239 | 7/1967 | Silverman | 367/81 |
| 3,355,139 | 11/1967 | Kittredge | 251/30.01 |
| 3,367,794 | 2/1968 | Bednar et al. | 166/66.5 |
| 3,512,549 | 5/1970 | Wiegand | 137/489 |
| 3,582,038 | 6/1971 | Harbonn et al. | 251/71 |
| 3,599,930 | 8/1971 | Bourgeot et al. | 251/73 |
| 3,640,140 | 2/1972 | Gulick et al. | 74/89.15 |
| 3,665,955 | 5/1972 | Conner, Sr. | 137/495 |
| 3,667,723 | 6/1972 | Schneider | 251/68 |
| 3,737,845 | 6/1973 | Maroney et al. | 166/66.4 X |
| 3,788,596 | 1/1974 | Maeda | 251/69 |
| 3,790,930 | 2/1974 | Lamel et al. | 340/18 NC |
| 3,814,181 | 6/1974 | Young | 137/484.6 |
| 3,961,308 | 6/1976 | Parker | 340/18 NC |
| 3,967,201 | 6/1976 | Rorden | 340/854 |
| 4,017,833 | 4/1977 | Broding | 346/33 C X |
| 4,073,341 | 2/1978 | Parker | 367/81 X |
| 4,129,184 | 12/1978 | Parker | 166/72 X |
| 4,147,222 | 4/1979 | Patten et al. | 175/9 |
| 4,191,248 | 3/1980 | Huebsch et al. | 166/66.4 |
| 4,261,379 | 4/1981 | Berry | 137/39 |
| 4,351,037 | 9/1982 | Scherbatskoy | 367/85 |
| 4,373,582 | 2/1983 | Bednar et al. | 166/72 |
| 4,468,665 | 8/1984 | Thawley et al. | 340/856 |
| 4,469,179 | 9/1984 | Crow et al. | 166/319 |
| 4,579,177 | 4/1986 | Going, III | 166/66.4 X |
| 4,617,960 | 10/1986 | More | 340/855 X |
| 4,639,901 | 1/1987 | Warmack et al. | 346/33 C X |
| 4,736,791 | 4/1988 | Rorden et al. | 166/66.4 |

FOREIGN PATENT DOCUMENTS

| | | |
|---|---|---|
| 0068985 | 1/1983 | European Pat. Off. . |
| 2085511 | 4/1982 | United Kingdom . |

*Primary Examiner*—Brian S. Steinberger

*Attorney, Agent, or Firm*—Cushman, Darby & Cushman

[57] ABSTRACT

A subsurface valve-actuator combination for well production tubing is described. The valve is urged to closed position but held open by a battery-operated latch of the actuator. A receiver-relay in the battery-actuator circuit maintains a switch closed to permit the latch to be energized as long as the receiver-relay receives an electromagnetic signal transmitted from the earth's surface. The latch is deenergized upon interruption of the signal and/or if the battery power is insufficient to energize the same.

9 Claims, 5 Drawing Sheets

ACTUATION METHOD

DISCLOSURE

BACKGROUND OF THE INVENTION

This invention relates generally to subsurface devices and, more particularly, to improvements in actuators for subsurface devices such as a valve of the type adapted to fail closed in response to the loss of a controlled condition. In one of its important aspects, this invention relates to an actuator of this type for use with a valve configured to control flow through a well bore extending below the earth's surface.

A valve often is installed in the lower end of a well being drilled and in oil or gas well production tubing for closing it in response to the velocity of the flow of well fluid therethrough, and thus, for example, to fail closed in the event of a blowout of the well. In one type of such a valve, the fluid flow velocity to which it reacts by closing, may be changed by adjustment of the sizes of the orifices in the body of the valve through which the well fluid flows or of the force of a spring urging the closure of the valve to an open state, or both. If, however, in a production well the pressure of the formation from which the fluid is produced drops to a low level and yet the fluid flow velocity remains above the threshold level, adjustment of either or both of the orifice sizes and of the spring force may seriously interfere with production.

In other prior valves of this type, the closure member is adapted to be held open by hydraulic control fluid, which may be supplied thereto from a source position in response to a reduction in the pressure of the control fluid to a predetermined low value. This loss in pressure of the control fluid may in turn occur in response to a predetermined well fluid pressure condition, such as a rapid loss of wellhead flow pressure indicative of a blowout, or to loss of some other controlled condition.

Valves of the latter type require a fluid conduit extending between the wellhead and the fluid responsive operator for the closure member. Thus, their response time is dependent on the distance the fluid conduit must extend, and to maintain a reasonable response time they are ordinarily installed relatively close to the source of control fluid, such as at the mud line of an offshore well. Thus a valve of this type often does not provide protection for the full length of production tubing, as does, (for example) a velocity type valve.

These and other problems could be overcome if a valve could be controlled by means at the surface requiring no physical connection with the valve, and thus be installable deep in the well at the valve location, as in the case of storm chokes, but at the same time independently of the condition of the well fluid, as in the case of surface controlled valves. While it has been proposed to communicate with a valve or other subsurface device mechanism deep within a well bore by transmitting electromagnetic signals from the earth's surface (ground or sea level) or from a sea bed, no means has yet been developed to transmit sufficient electromagnetic power through the earth's surface for operating such a valve or subsurface device. While a source of electromagnetic power, such as a battery pack, can be included with the subsurface device the level of electrical power which can be expected to be produced by the same reliably is not sufficient to operate some subsurface devices such as a valve. That is, due to power drain from a battery pack, which is especially rapid in well bores where the temperature may be as high as 300° F., the energy available at the subsurface level would be limited, especially over a long period of time. This would be a particular problem in the case of a subsurface valve of the type described for a production well. Such a valve may be left in a well for years, and may have to operate—i.e., open, close and then reopen—many times, due, for example, to unavoidable losses of the controlled condition or to a planned loss for test purposes.

BRIEF SUMMARY OF THE INVENTION

It is the primary objective of this invention to provide a method for actuating a subsurface device permitting the latter to be installed deep in a well bore and be controlled by electromagnetic signals from the surface. A more particular object is to provide such a method for actuating which does not require subsurface electromagnetic power to change the state of a subsurface device, such as to either open or close a subsurface valve. Still a further object is to provide an actuator as described which when combined with a valve provides a combination which may be interchanged with a storm choke controlling an existing production well. Yet another object is to provide such an actuator having a sealed chamber in which the power source and other electrical components of the system may be contained for protection from the surrounding environment, and, more particularly, having such a chamber which does not require a seal between the mechanical components of the system and the electrical components.

These and other objects are accomplished, in accordance with the illustrated embodiment of the present invention, by the provision of an actuator for a subsurface device adapted to be installed with the device within a well, such as at the lower end of production tubing. The device includes means for urging it from a first state to a second state. If the subsurface device is a valve, one of the states, such as the first state, is an open condition and the other of such states, such as the second state, is a closed condition. The actuator includes a latch for normally retaining the device in a selected one of the states, which latch has a member movable between a first latching position associated with a selected state and a second unlatching position associated with the other of the states. Means are provided for controlling movement of the member between such states, which means most desirably includes means for normally retaining the member in its latching position and means for urging the member toward its unlatching position whenever it is not retained in the latching position.

As another feature of the invention, the actuator includes a source of electrical power, such as a battery pack, provided at the location of the actuator. The output of the source is communicably connected with the latch means to release the aforesaid member from its latching position whenever the power output of the source passes a predetermined threshold level, such as a selected low power level. A receiver-relay is also included as part of the actuator at the location of the same, which receiver-relay responds to an electromagnetic signal transmitted from the earth's surface by maintaining the level of power output at a level or levels different from the threshold level as long as the power source is capable of maintaining such an output. That is, the actuator preferably is designed for use with subsurface devices in which the only power required at the subsurface location is that needed to control operation of the actuator itself, e.g., to provide a force to hold or retain energy stored to change the state of the subsurface device, such as to change a valve from its open to its closed state. As will be apparent from the description to follow, the actuator force may be of a very minor magnitude.

BRIEF DESCRIPTION OF THE DRAWINGS

In the drawings, wherein like reference characters are used throughout to designate like parts.

DETAILED DESCRIPTION OF THE INVENTION

Figure 1:
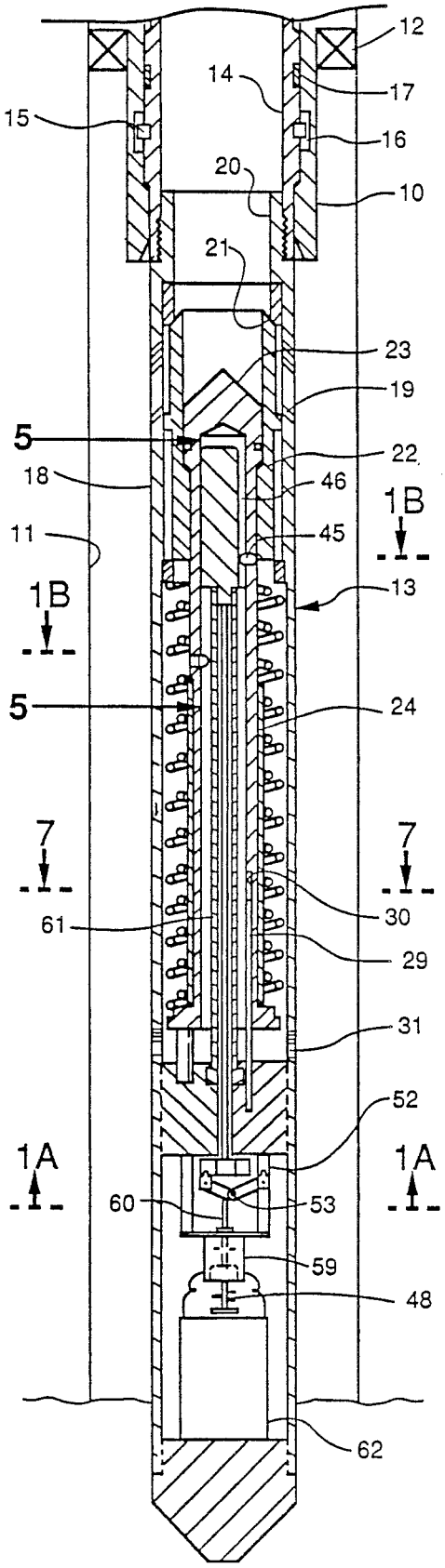
FIG. 1 is a vertical sectional view of a valve and actuator of the invention, supported within the lower end of a production tubing string and with the valve closure member in closed position.
Figure 3:
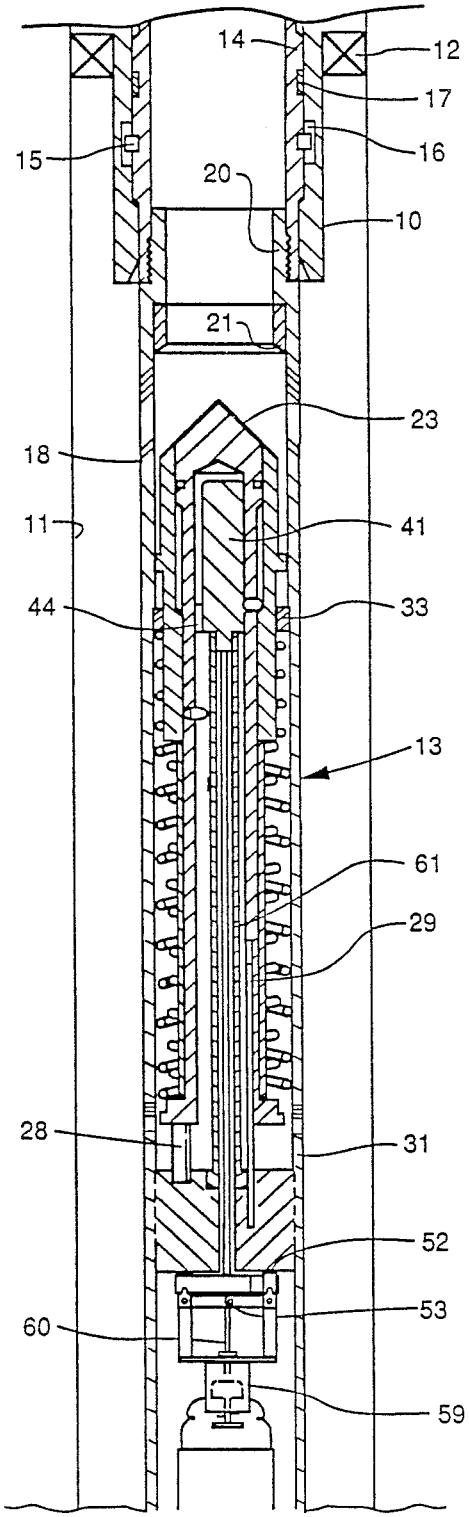
FIG. 3 is another vertical sectional view of the valve and actuator, similar to FIGS. 1 and 2, but upon lowering of the valve closure member to its open position in response to a balancing of the pressure of well fluid across the closure member.
Figure 4:
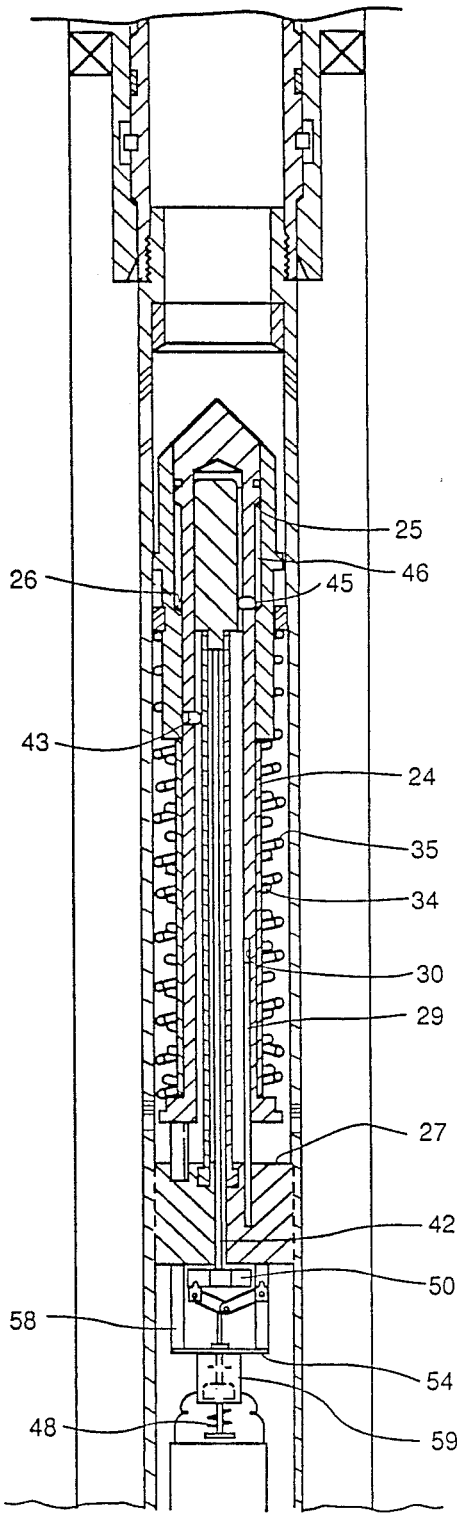
FIG. 4 is still another vertical sectional view of the valve and actuator, similar to FIGS. 1, 2 and 3, but upon retraction of the armature of the actuator solenoid in response to the loss of power from the battery, so as to unlock the valve retainer and closure member and permit the closure member to be moved upwardly to the closed position of FIG. 1.

With reference now to the details of the above-described drawings which illustrate the presently contemplated best mode of practicing the invention, the lower end of a well production tubing 10 is shown in each of FIGS. 1 and 4 within a well bore 11 which may be lined with casing. The tubing is packed off at 12 to close the annular space between it and the well bore above a production zone from which oil or gas is to be recovered through the tubing. As also shown in each of FIG. 1—4, a valve and actuator of the present invention, indicated in their entirety by a reference character 13, are located in the well bore to control the flow of fluid through the tubing and, more particularly, for the valve to fail upon the loss of a controlled condition, as will be described hereinafter. Thus, the valve-actuator combination is connected to the lower end of a tubular member 14 which is supported within the tubing string 10 by means of locking elements 15 received within a recess 16 in the bore of the tubing string 10, and then sealed with respect thereto by a packing 17 about the tubular member 14.

As shown, the valve of the combination 13 includes a generally cylindrical body 18 having its open upper and threadedly and sealably connected to the lower end of tubular member 14, and having ports 19 in its side connecting with the well bore beneath the lower end of the tubing string 10. A seat 21 is formed on the body within the flowway between the ports and the open upper end of the body 18, and a closure member including a sleeve 22 is vertically reciprocal within the body between an upper position in which the sleeve engages the seat to close the valve, as shown in FIG. 1 and 2, and a lower position in which it is spaced from the seat, substantially at the level of the lower end of the ports 19, so as to open the flowway, as shown in FIG. 3 and 4.

Figure 2:
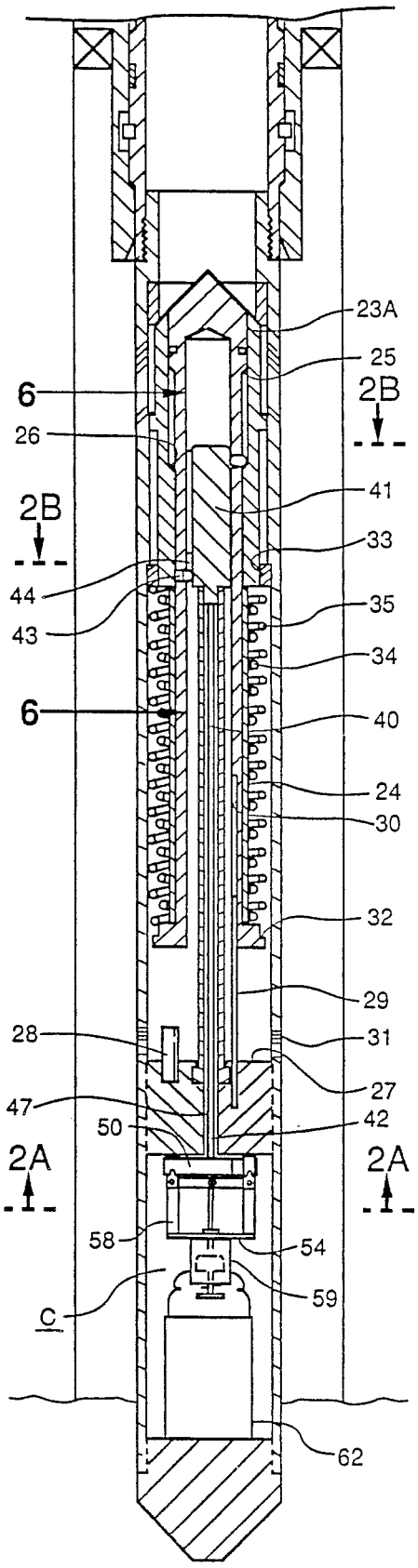
FIG. 2 is a vertical sectional view of the valve and actuator, similar to FIG. 1, but upon the bleeding of the pressure of well fluid from above the valve closure member so as to cause the valve retainer to move to its upper position, with the toggle link arrangement of the actuator held in an extended position to which it is lifted upon raising of the valve retainer to its upper position.

A retainer 23 is guidably reciprocal within the closure member sleeve 22 between an upper position with respect thereto, as shown in FIGS. 2, 3 and 4, wherein its upper end provides an upwardly extending conical continuation of the upper end of the sleeve, and a lower position with respect thereto, as shown in FIG. 1. The retainer is located in its upper position with respect to the closure member sleeve by the engagement of a sleeve 24 thereabout with the lower end of the closure member sleeve 22, and is located in its lower position with respect to the closure member sleeve by engagement of a shoulder 25 about the retainer with a seat 26 formed on the inner diameter of the sleeve 22. A piston 23A at the upper end of the retainer is sealably reciprocable within the closure member sleeve so that, as will be described to follow, the retainer may be caused to reciprocate between its upper and lower position in order to generate energy which is used in opening, closing and reopening the valve in response to the pressure of the well fluid above and below it when closed.

The body of the valve-actuator combination 13 includes a transverse wall 27 which separates it into an upper chamber in which the valve closure member and retainer are disposed, and a lower chamber C which, as will be described, is maintained at atmospheric pressure and in which the battery, solenoid and other electrical components of the control system are contained. A pin 28 extends upwardly from the wall 27 to provide a stop for engaging the lower end of the retainer and thus limiting its downward movement with respect to the valve body. The retainer is held against rotations with respect to the body by means of a rod 29 extending upwardly from the wall 27 into a longitudinal slot 30 formed on the inner diameter of the retainer adjacent its lower end. The slot is of such length that the rod remains within it during reciprocation of the retainer with respect to the body. Since the upward movement of the retainer with respect to the closure member sleeve is limited by engagement of sleeve 24 with the lower end of the valve member sleeve 22, the upward movement of the retainer with respect to the body is limited by engagement of the upper end of the valve member sleeve with the seat 21 of the valve body.

Ports 31 are formed above the transverse wall 27 so that well pressure above such wall is balanced within and without the valve-actuator combination beneath retainer piston 23A. Of course, when the valve member is in the open position of FIGS. 3 and 4, the pressure of the well fluid above and below the closure member is substantially the same. On the other hand, when the valve member has been moved to the closed position of FIGS. 1 and 2, the well fluid above the closure member may be bled off so as to create an upwardly directed pressure differential across the closed valve member, which, for purposes previously mentioned and to be described in detail to follow, causes the retainer to be raised to the position of FIG. 2 in order to set or reset the valve for movement to its open position of FIG. 3.

The retainer has a flange 32 about its lower end, and a stop 33 is mounted on the inner diameter of the body across the flange and generally intermediate the upper and lower ends of the body. A first coil spring 34 surrounds the retainer sleeve 24 and is compressed between the lower end of the valve closure member sleeve 22 and the flange 32 so as to urge the valve closure member upwardly with respect to the retainer sleeve, and a second coil spring 35 is disposed about the first coil spring and is compressed at its opposite ends between the stop 33 and the flange so that it urges the retainer downwardly with respect to the body, and thus, as shown in each of FIGS. 1, 3 and 4, into a lower position in which the lower end of the retainer engages stop 28.

When the valve is closed, as shown in FIG. 1, either upon installation or in response to the loss of the controlled condition, both the first and second springs are fully expanded or deenergized. Well fluid pressure above the closure member may be bled off to cause the retainer member to rise to the position of FIG. 2, and thereby compress and energize the springs in order to generate energy therein. More particularly, the retainer is locked in its upper position with respect to the closure member, so long as the controlled condition has been established and maintained, in order to set or reset the valve.

Figure 5:
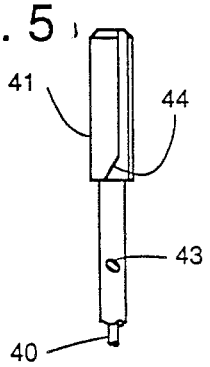
FIG. 5 is a side view of the control rod removed from the retainer, and as seen along broken lines 5—5 of FIG. 1.
Figure 6:
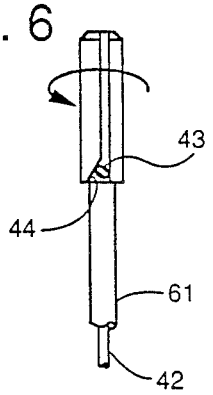
FIG. 6 is another side view of the rod, as seen along broken lines 6—6 of FIG. 2.
Figure 7:
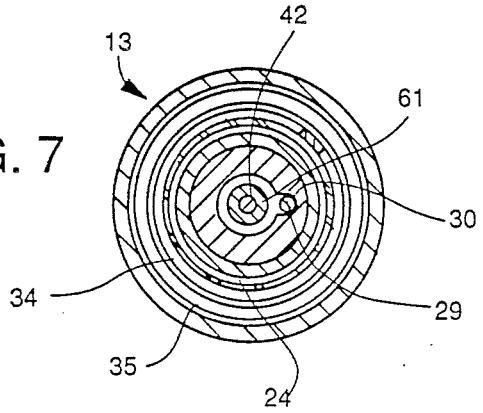
FIG. 7 is another cross-sectional view of the valve and actuator, as seen along broken lines 7—7 of FIG. 1.

As also shown in each of FIGS. 1–4, a rod 40 extends longitudinally within the retainer, and has an enlarged head 41 at its upper end which fits closely within the upper hollow end of the retainer, and a lower end 42 which extends through a hole 47 in the transverse wall 27 of the body connecting the upper and lower chambers thereof. A pin 43 carried by the retainer projects into its inner diameter to a position beneath the enlarged head 41 of the rod when the retainer is in a lower position with respect to the rod, as shown in FIG. 1 and 5. As the retainer 23 moves upwardly, the pin 43 moves into the lower end of a slot 44 in the head of the rod, as shown in FIGS. 2 and 2B, which slot, as shown in FIG. 6, extends at an angle with respect to the vertical so as to rotate the rod approximately 10° with respect to the retainer as the retainer moves to its upper position, as shown in FIG. 2 and 6.

A pin 45 is also carried within a hole extending through the retainer at a location opposite the enlarged head 41 of the rod and thus is at a position to move above shoulder 26 on the inner diameter of the closure member 22, when fluid pressure above the retainer is bled off to cause it to be moved upwardly to the position of FIG. 2, and pin 43 on the retainer to move into slot 44. As shown in FIG. 2B, the resulting rotation of the head of the rod cams the inner end of pin 45 out of a slot 46 in the right side of the head, and beyond the outer diameter of the retainer above the seat 26. At this time then, the retainer is locked against downward movement with respect to the valve member sleeve, and, conversely, the valve member sleeve is locked against upward movement with respect to the retainer. Since the sleeve 24 has engaged the lower end of the closure member sleeve, the retainer is held against further upward movement with respect to the closure member, which of course is seated and thus prevented from moving up.

Figure 1A:
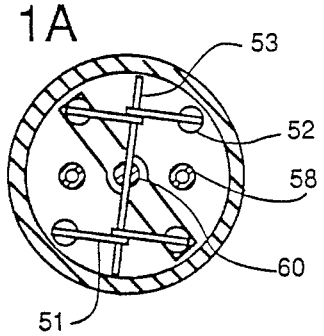
FIGS. 1A—1A and 1B—1B are cross-sectional views of the valve and actuator, as seen along broken lines 1A—1A and 1B—1B, respectively, of FIG. 1.
Figure 2A:
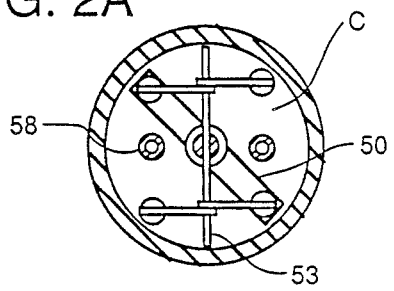
FIGS. 2A—2A and 2B—2B are cross-sectional views of the valve and actuator, as seen along broken lines 2A—2A and 2B—2B, respectively, of FIG. 2.
Figure 2B:
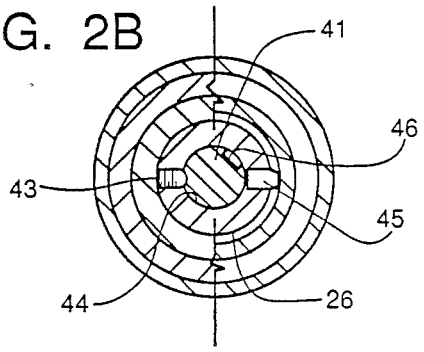
Figure 8:
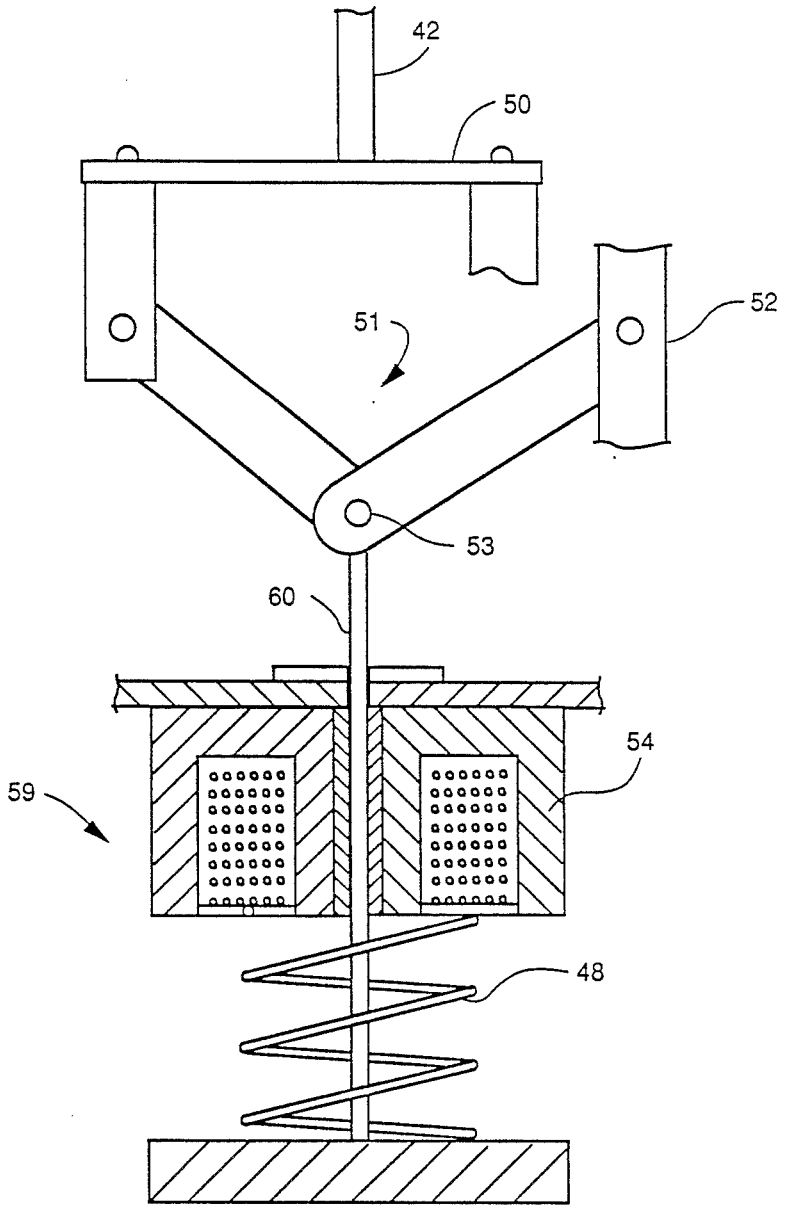
FIG. 8 is an enlarged, partly broken away and schematic illustration of components of the actuator of the invention.

As shown in FIGS. 1A, 2A and 8 as well as in FIGS. 1–4, the lower end 42 of the rod which extends through hole 47 in the wall 27 is connected to an arm 50 within the atmospheric chamber C so as to rotate the arm from the position shown in FIG. 1A to the position shown in FIG. 2A as the retainer moves upwardly from the position of FIG. 1 to the position of FIG. 2, and thus as the pin 43 moves into the slot 44 in the head of the upper end of the rod so as to transmit rotation to the rod relative to the retainer. Each outer end of the arm 50 is pivotally connected to one arm of a toggle link 51 (FIGS. 1A, 2A and 8) having its other arm pivotally connected to a bracket 52 extending downwardly from the transverse wall 27 within the atmospheric chamber, and the arms of the toggle links are connected to one another by means of a rod 53 extending between them. (For simplicity in showing, only the portion of the toggle link 51 at one end of the rod 53 is illustrated in FIG. 8.) As will be understood from the drawings, rotation of the arm 50 with the control rod 40 will move the outer ends of the toggle links further apart, and thus move the toggle links from the collapsed position of FIG. 1 to the extended position of FIG. 2. Swivel pin connections are provided between the ends of the arms and the links, as well as between the brackets and the links.

A platform 54 is suspended from the lower side of the transverse wall 27 by bracket arms 58 extending downwardly from the wall to support a solenoid 59 with an extendible and retractable armature having an end 60 thereof connected to the rod 53 extending between the toggle links. Thus, as the toggle links are extended, the end 60 of the armature is raised with the rod to the position shown in FIG. 2 to hold the links extended so long as the controlled condition is maintained. On the other hand, when the valve is open as shown in FIGS. 3 and 8 and the controlled condition is lost, the solenoid is inoperable to oppose the force of a small spring 48 acting between the body of the solenoid and an end of the solenoid armature opposite the end 60. Thus, the links are moved off of dead center to permit them to be collapsed, in response to rotation of the control rod, as shown in FIG. 3, and thus to release the closure member for upward movement from the position of FIG. 4 to the position of FIG. 1.

Figure 1B:
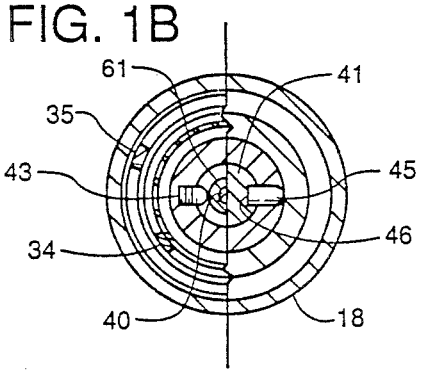

A torque tube 61 surrounds the control rod and is anchored at one end of the transverse wall 27 of the valve body and at the upper end of the head of the control rod. The torque tube thus provides a spring force for urging the control rod from the position of FIG. 3 to the position of FIG. 4, so as to rotate the enlarged upper end of the control rod to a position in which slot 46 is opposite the inner end of pin 45. Thus, as shown in FIGS. 1 and 1B, the pin may be urged inwardly from above shoulder 26 and into slot 46 to free the closure member sleeve for movement upwardly with respect to the retainer, and thus from the position of FIG. 4 into the closed position of FIG. 1 in engagement with the seat 21. Also, of course, the torque tube closes the annular space about the rod as the rod rotates between its alternate positions and thus closes the chamber C.

Solenoid 59 is electrically connected to a battery pack power source 70 within a container 62 mounted within the atmospheric chamber C, and is of a so-called "zero air gap" type. It has a face on the lower end of its armature opposite an end of its stator core as shown in FIG. 8. When well pressure above the closure member has been bled off and the toggle link has been extended, as shown in FIG. 2, the armature face in held against the stator core so long as the controlled condition is maintained to cause the battery 70 to energize the solenoid 59. Thus, the toggle is held in extended position with a force which need only be greater than that of spring 48, so that the battery drain required to hold the valve in open position over an extended period of time is minimal. That is, unlike the usual applications of a solenoid, the solenoid of the actuator does not have to do work by causing motion against a restraining force in order to provide the latching function. To put it another way, the solenoid does not have to deliver mechanical energy; it only has to control the release of energy from energy storage spring 34. The energy so released performs the work of closing the valve, and that energy is restored by resetting the valve (rather than by the solenoid) to enable the cycle to be repeated. This allows the actuator to be a fail-safe one which requires very little power to keep the valve open; yet interruption of power, either intentionally or by failure, will cause the valve to close, which is the safe condition. Any conventional magnetic relay construction which results in all air gaps in the magnetic core to be essentially closed when the movable armature is pulled in will exhibit, to some degree, the desired high hold-in force at lower power. Achieving an adequately low power requirement for a given hold-in force in an actuator of limited size, and still assuring its release when power is interrupted, requires careful selection of the magnetic core material for the solenoid. In contrast with standard utilizations of solenoids, high saturation flux density is not important in this application. Two important properties are: high permeability about the operating point, which results in high flux density for hold-in; and low remanent induction to ensure release when power is interrupted. Ferrites, such as Siemens type N30, have been found suitable for this application. An additional benefit of using ferrite for the magnetic structure is its frequency tolerance. At the very low power level required (one milliwatt or less) it is difficult to obtain high enough resistance in a solenoid to drive it directly from the available power supply voltages. However, its high inductance and low AC losses permit it to be driven by a low duty-cycle pulse train directly from the output of a CMOS digital device. If the pulse repetition rate is high enough (10 to 100 Hz may be sufficient) the inductance will prevent appreciable change of current, and the DC drive voltage will be the duty cycle times the supply voltage, obtained at high efficiency.

An appropriate configuration for the solenoid is one having a circular "pot" core, as illustrated in FIG. 8. Ideally, the axial length of the core is about equal to its radius, and the cross-sectional areas of the armature core material and the winding are similar, to give the greatest force-to-power ratio for a given total volume. In practice, the dimensions of commercially available "cup" cores, in which the magnetic structure comprises two symmetrical halves, is adequate.

Figure 9:
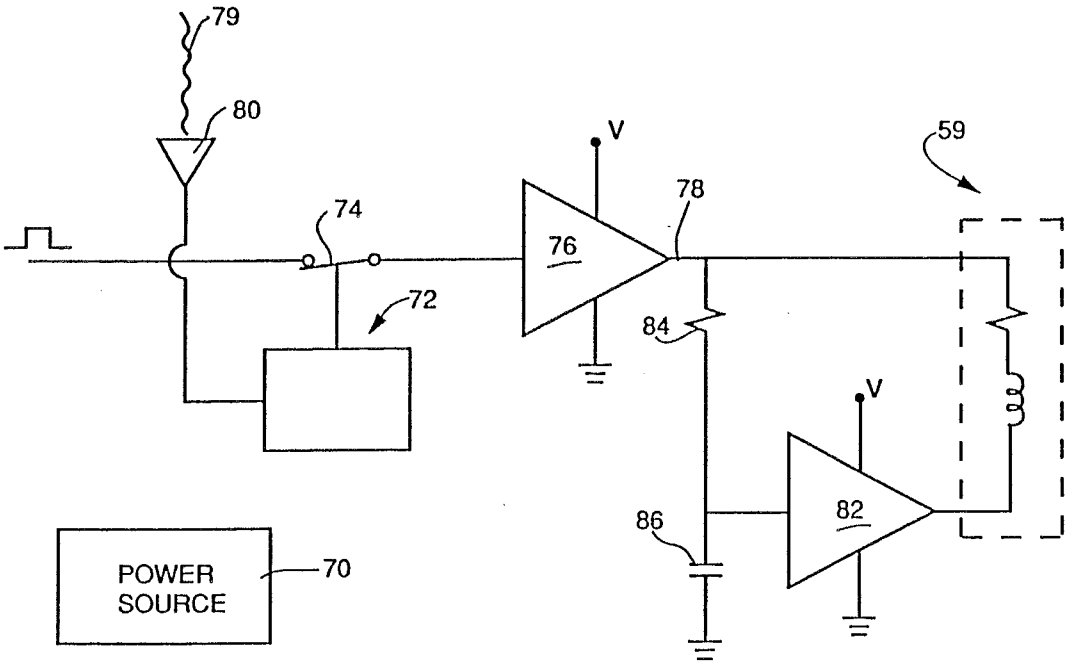
FIG. 9 is a schematic electrical diagram of the control electronics included as part of the actuator of the invention.

Reference is made to FIG. 9 which functionally and schematically illustrates a pulse drive circuit for the solenoid 59. Such circuit includes means to assure that the core of the solenoid is not energized so that the armature is released from its latching position whenever the power output of the source (average power when a pulse train is used to energize the solenoid core) is lower than a required threshold output. The power will drop below such threshold level if the circuit between the power source and the core is interrupted or if the power source fails or becomes weak. A pulse train is fed through a switch 74 to be discussed in more detail hereinafter, to the input of a buffer 76. That is, the desired peak voltage for the core is fed to the buffer 76 from the battery pack power source represented at 70 so that the output 78 of such buffer will deliver the desired driving pulses to the core of the solenoid in response to its input receiving a pulse signal. This will result in the toggle links 51 being maintained in their extended positions to latch the valve opened.

If, for example, the solenoid core has a resistance of approximately 1000 ohms and an inductance of approximately 1002, it will maintain the armature in the position shown in FIGS. 2 and 3 against a force of several pounds provided, for example by the spring 48, with a current of approximately 1 milliampere. Thus, if the drive voltage on the output 78 varies between 5 volts and 0 volts with the 5 volts lasting for approximately 2 milliseconds out of every 10 milliseconds, and there being 0 volts for the remaining 8 milliseconds, the average voltage fed to the solenoid will be about 1 volt and the average current through the solenoid will be the desired 1 milliamp with less than pulse or minus 5% ripple.

As a salient feature of the actuator of the invention, it includes means for controlling energization of the solenoid. That is, as is illustrated in FIG. 9, a receiver-relay 72 is positioned within the circuitry to interrupt when desired the input to buffer 76. Such receiver-relay includes the switch 74 mentioned previously, which is urged into an open position. Receiver-relay 72 is controlled by an electromagnetic signal 79 generated at the earth's surface (either at ground or water level) and transmitted through the earth to an antenna 80 connected to the remainder of the receiver-relay. The antenna most desirably is one which is responsive to the magnetic component of an electromagnetic signal, although from the broad standpoint the antenna could be one responsive to the electric component of such a signal. The armature of the solenoid 59 will be maintained in the latched position as long as the solenoid core receives sufficient power to maintain such armature in the "hold-in" position, i.e., as long as such power does not pass through a predetermined threshold level. The receiver-relay 72 responds to the signal received by the antenna 80, by permitting the drive signal to reach the buffer 76 as long as an electromagnetic signal is received. That is, the buffer 76 maintains the level of power output received by the solenoid at a level or levels different from the threshold level as long as the power source is capable of maintaining such an output.

Although the function has been described in connection with hardware, it is preferred that it be obtained by appropriately programming a microprocessor, such as Model 6805 available from the Motorola Corporation, to furnish the output 78.

The use of pulse drive affords an additional benefit in the form of a simple method to protect against latch-up of the driver. With reference to FIG. 9, it will be seen that the output 78 of the buffer 6 is fed to an additional CMOS buffer 82 through the resistance 84 of an RC network which also includes a capacitor 86. The time constant of the RC network is selected to be long compared to the pulse output repetition rate. The result is that the input to the buffer 82 will be about the same as the average output of the buffer 76, with less than sufficient deviation to pass through the threshold level of the buffer. For example, if the output of buffer 78 is on the average about 1 volt, the input to the buffer 82 also will be about 1 volt. Buffer 82 is selected so that such input will be below its threshold level and its output therefore will b 0. Thus, as long a the receiver-relay receives an electromagnetic signal and maintains the switch 74 closed, it will permit power to reach solenoid 59. If the output 78 should stop in one state, the solenoid latch will release, closing the valve. (This is assuming, of course, that there is not a simultaneous failure of amplifier 82 to the opposite state.) If, for example, the output 78 tails "1cw" the solenoid obviously will release since the output of buffer 82 also will remain low. If, however, the output 78 of the buffer 76 should fail "high" the solenoid current will initially increase. Capacitor 86 will charge, though, toward the high state and when its voltage crosses the threshold of amplifier 82, the amplifier will be switched to the voltage on its power input pin. As long as such voltage is equal to the voltage on output 78, the current will decay to 0, releasing the armature and closing the valve.

To summarize operation of the valve-actuator combination, and assuming the valve to be in the reset position of FIG. 2 wherein energy is generated in both of the coil springs, and the solenoid has been energized by a signal 78 to engage its end 60 with the rod 53 extending between the toggle links and thus hold the toggle links in extended position, well pressure may be equalized across the closed valve member to permit energy generated in coil spring 35 to be released in order to move both the valve member and the retainer downwardly from the closed position of FIG. 2 to the open position of FIG. 3. Although this removes pin 43 from slot 4, the rod is not free to rotate, and the pin 45 continues to remain in a locked position to hold the retainer in its upper position with respect to the closure member, as long as the solenoid is energized. However, when the solenoid is deenergized, spring 48 moves the toggle links 51 off center to permit them to be collapsed by the spring force in the torque tube. As the arm 50 is rotated, the head at the upper end of the control rod is rotated to a position in which the slot 46 therein is opposite the pin 45 so as to receive the pin, as shown in FIG. 4. The retainer and the closure member sleeve are thus unlocked and the sleeve is permitted to be moved upwardly by the inner coil spring 34 form its lower position with respect to the retainer to its upper position with respect thereto and thus the upper end of the closure member is permitted to move into engagement with the seat 21 to close the valve, as shown in FIG. 1.

As previously described, the controlled condition in the illustrated embodiment of the invention is the maintenance of a power level sufficient to energize the solenoid 59 and thus hold the toggle links 51 in extended positions. As stated above, this invention contemplates that a signal 79 may be transmitted from the earth's surface to a receiver-relay 72 for closing the switch 74 to electrically connect the battery pack 70 to the solenoid, and thus energize the solenoid so long as the power level of the battery pack has not been drained below the necessary level. This signal could, as previously mentioned, be electromagnetically communicated through the earth itself, and the relay 72 could include an antenna 80 adapted to receive and transmit the signal to the relay. In any event, this signal may be selectively interrupted so as to deenergize the solenoid 59 by disconnecting it from the battery-pack 70, and thus rendering the solenoid inoperative to hold the toggle links 51 extended. As also previously mentioned, however, the valve is fail-safe even if the signal continues to be transmitted, but the level of the power of the battery pack 70 has fallen below the predetermined level whereby the solenoid 59 is rendered inoperative to hold the energy generated in the inner coil spring.

Further, alternatives to the use of solenoid 59 as the latch for the actuator are possible. One possible alternative is to use a piezoelectric material that changes shape in response to an applied voltage. This phenomenon occurs naturally in quartz and in some specially fabricated ceramics such as lead zirconate. Thick shapes, such as stacks of discs, can be used to create a relatively large force. Another possible alternative is to use a device known as a "bender", which is analogous to a bimetallic strip, and can produce motions in response to an applied voltage.

From the foregoing, it will be seen that this invention is well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims. And as many possible embodiments may be made of the invention without departing from the scope thereof, it is to be understood that all matter herein set forth or shown in the accompanying drawings is to be interpreted as illustrative and not in a limiting sense.

What is claimed is:

1. In a method of controlling operation from a remote control location of a device located downhole in a well, the steps comprising:

A. Providing a self-contained source of power at the downhole location of said device;

B. Generating a signal at the remote control location indicating the time the device is to operate downhole in a selected operating state;

C. Transmitting the generated signal from said remote control location toward the downhole location of said device;

D. Receiving a signal at said downhole location during all of the time said device is to operate is said selected state, said signal causing said operation;

E. Directing operation of said device in said selected state during said time, while as said source of power is capable of maintaining a power output greater than a predetermined threshold level; and F. Using a latch to disconnect said device from said power source when a state of said source indicates that said source will not be capable of maintaining a power output greater than a predetermined threshold level.

2. The method of claim 1 wherein said self-contained source of power is a source of electrical power, and said step of directing operation of said device includes directing to said latch, a train of control pulses generated from said source, the average power provided by said pulse train being greater than said threshold level as long as said source is capable of maintaining such a power output.

3. The method of claim 2 further including the step of providing means preventing a steady-state supply of power to said latch at a power output level higher than said predetermined threshold level from causing continuous delivery to said latch of an average power output greater than said predetermined threshold level.

4. The method of claims 1 or 2 wherein another operating state of said device is a default state, further comprising the step of directing operation of said device in said default state whenever said device is not being operated in said selected state.

5. The method of claims 1 or 2 wherein said steps of generating a signal includes generating said signal continually when said device is selected to operate in said selected state; and said step of transmitting said signal when said device is selected to operate in said selected state; and said step of receiving the signal at said downhole location includes continually receiving a signal at said downhole locating during the selected time of operation of said device in said selected state.

6. The method of claims 1 or 2 wherein said remote control location is substantially at or above one of the earth or sea surfaces and said downhole location is beneath the earth's surface.

7. The method of claims 1 or 2 wherein said step of transmitting the generated signal includes electromagnetically transmitting the generated signal through the earth adjacent said well from said remote control location toward the downhole location of said device.

8. The method of claim 7 wherein said step of generating a signal includes generating an electromagnetic signal defining in the magnetic component of said signal, a time selected for that the device to operate in said selected state; and said step of transmitting the signal includes transmitting the magnetic component of said signal toward said downhole location.

9. The method of claims 1 or 2 wherein means are provided for powering said device between said operating states and said step of providing a self-contained source of power includes providing a self-contained source of power which is separate of means for powering said device between said operating states.

* * * * *